US012351949B2

(12) United States Patent
Ito et al.

(10) Patent No.: US 12,351,949 B2
(45) Date of Patent: Jul. 8, 2025

(54) SYNTHETIC FIBER TREATMENT AGENT AND SYNTHETIC FIBER

(71) Applicant: TAKEMOTO YUSHI KABUSHIKI KAISHA, Gamagori (JP)

(72) Inventors: Jun Ito, Gamagori (JP); Keiichiro Oshima, Gamagori (JP); Takeshi Nishigawa, Gamagori (JP)

(73) Assignee: TAKEMOTO YUSHI KABUSHIKI KAISHA, Gamagori (JP)

( * ) Notice: Subject to any disclaimer, the term of this patent is extended or adjusted under 35 U.S.C. 154(b) by 0 days.

(21) Appl. No.: 17/905,186

(22) PCT Filed: Jun. 7, 2021

(86) PCT No.: PCT/JP2021/021505
§ 371 (c)(1),
(2) Date: Aug. 29, 2022

(87) PCT Pub. No.: WO2021/251320
PCT Pub. Date: Dec. 16, 2021

(65) Prior Publication Data

US 2023/0119627 A1 Apr. 20, 2023

(30) Foreign Application Priority Data

Jun. 12, 2020 (JP) ..... 2020-102307

(51) Int. Cl.
*D01F 11/14* (2006.01)

(52) U.S. Cl.
CPC ..... *D01F 11/14* (2013.01); *D10B 2101/12* (2013.01)

(58) Field of Classification Search
CPC .. D06M 13/165; D06M 15/53; D06M 15/643; D06M 15/17; D06M 2200/40; D01F 11/14
See application file for complete search history.

(56) References Cited

U.S. PATENT DOCUMENTS

2003/0186833 A1* 10/2003 Huff ..... C08L 51/08 510/475
2018/0030649 A1 2/2018 Hotta et al.
2021/0002820 A1 1/2021 Maeda et al.

FOREIGN PATENT DOCUMENTS

CN 105189856 A 12/2015
CN 108368671 A 8/2018
DE 112016000638 T5 11/2017
JP H10168669 A * 6/1998
(Continued)

OTHER PUBLICATIONS

Espacenet translation of JPH10168669A. (Year: 1998).*
(Continued)

*Primary Examiner* — Jeremy R Pierce
*Assistant Examiner* — Christine X Nisula
(74) *Attorney, Agent, or Firm* — CANTOR COLBURN LLP

(57) ABSTRACT

A synthetic fiber treatment agent and synthetic fibers including the synthetic fiber treatment agent, wherein the synthetic fiber treatment agent contains a silicone and a polyoxyalkylene alkyl ether in which an alkylene oxide with 2 to 4 carbon atoms is added at a ratio of 1 to 30 moles in total to 1 mole of a monohydric aliphatic alcohol having a hydroxy group at a β-position of an alkyl chain with 4 or more carbon atoms.

7 Claims, 1 Drawing Sheet

(56) References Cited

FOREIGN PATENT DOCUMENTS

| | | | | |
|---|---|---|---|---|
| JP | 2004149983 | A | | 5/2004 |
| JP | 2004183124 | A | | 7/2004 |
| JP | 2012046855 | A | | 3/2012 |
| JP | 2016084563 | A | * | 5/2016 |
| JP | 6632016 | B1 | | 1/2020 |
| WO | 2017169632 | A1 | | 10/2017 |

OTHER PUBLICATIONS

Espacenet translation of JP 2012046855A. (Year: 2012).*
Espacenet translation of JP-2016084563-A. (Year: 2016).*
International Search Report for Application No. PCT/JP2021/021505 mailed Aug. 10, 2021.
Office Action in German Patent Application No. 11 2021 001 589.3, Date of Mailing Mar. 29, 2023, 13 pages.
"Re-evaluation of dimethyl polysiloxane (E 900) as a food additive," EFSA Journal, Mar. 26, 2020, 47 pages.

* cited by examiner

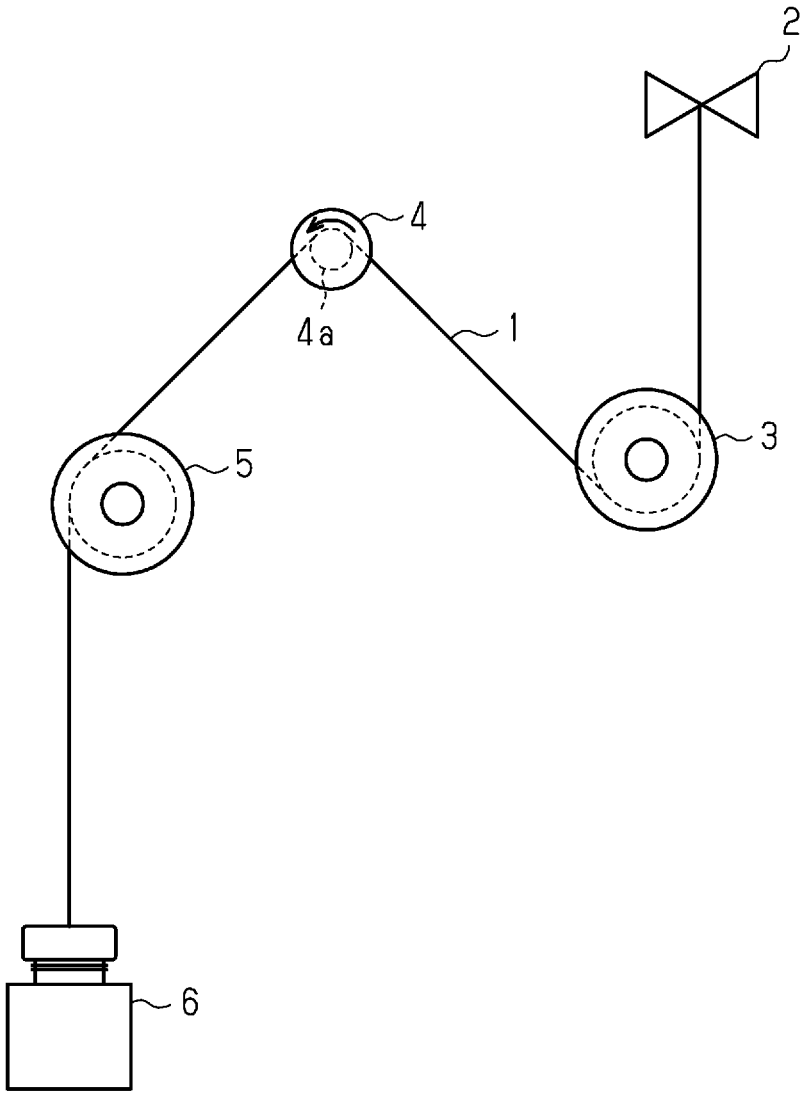
2
4
4a
1
3
5
6

SYNTHETIC FIBER TREATMENT AGENT AND SYNTHETIC FIBER

TECHNICAL FIELD

The present invention relates to a synthetic fiber treatment agent and to a synthetic fiber.

BACKGROUND ART

Carbon fibers are produced, for example, by performing a spinning step of spinning an acrylic resin into fibers, a dry densification step of drying and densifying the spun fibers, a drawing step of drawing the dry densified fibers to produce a carbon fiber precursor that is synthetic fibers, a flame-resisting treatment step of making the carbon fiber precursor flame-resistant, and a carbonization step of carbonizing the flame-resistant fibers.

A synthetic fiber treatment agent is used at times in the process of producing the synthetic fibers to improve a bundling property of the fibers.

An acrylic fiber treatment agent that contains an amino-modified silicone and a polyoxyalkylene alkyl ether is disclosed in Patent Document 1.

PRIOR ART LITERATURE

Patent Literature

Patent Document 1: International Publication No. WO 2017/169632

SUMMARY OF THE INVENTION

Problems that the Invention is to Solve

Further performance improvement of a synthetic fiber treatment agent is being sought in terms of the effect of improving the bundling property in a process of producing synthetic fibers.

The present invention has been made in view of such circumstances and an object thereof is to provide a synthetic fiber treatment agent that enables a bundling property of synthetic fibers to be improved suitably. It is also an object of the present invention to provide a synthetic fiber to which this synthetic fiber treatment agent is adhered.

Means for Solving the Problems

A synthetic fiber treatment agent for solving the above problem contains a polyoxyalkylene alkyl ether in which an alkylene oxide with 2 to 4 carbon atoms is added at a ratio of 1 to 30 moles in total to 1 mole of a monohydric aliphatic alcohol having a hydroxy group at a β-position of an alkyl chain with 4 or more carbon atoms.

Regarding the synthetic fiber treatment agent, the alkylene oxide preferably contains ethylene oxide.

Regarding the synthetic fiber treatment agent, the monohydric aliphatic alcohol preferably has the hydroxy group at a β-position of an alkyl chain with 10 to 18 carbon atoms.

Regarding the synthetic fiber treatment agent, the monohydric aliphatic alcohol preferably has the hydroxy group at a β-position of an alkyl chain with 12 to 16 carbon atoms.

The synthetic fiber treatment agent preferably further contains a silicone.

Regarding the synthetic fiber treatment agent, the silicone preferably contains an amino-modified silicone.

Regarding the synthetic fiber treatment agent, if the sum of the contents of the polyoxyalkylene alkyl ether and the silicone is taken as 100 parts by mass, the contents of the polyoxyalkylene alkyl ether is preferably 5 to 80 parts by mass and the content of the silicone is preferably 95 to 20 parts by mass.

Regarding the synthetic fiber treatment agent, the synthetic fiber is preferably a carbon fiber precursor.

A synthetic fiber for solving the above problem is a synthetic fiber to which the synthetic fiber treatment agent is adhered.

Effects of the Invention

The present invention succeeds in suitably improving the bundling property of synthetic fibers.

BRIEF DESCRIPTION OF DRAWINGS

FIG. 1 is a schematic view of an apparatus for measuring smoothness.

MODES FOR CARRYING OUT THE INVENTION

First Embodiment

A first embodiment that embodies a synthetic fiber treatment agent according to the present invention (also referred to hereinafter simply as treatment agent) will now be described.

The treatment agent of the present embodiment contains a polyoxyalkylene alkyl ether in which an alkylene oxide with 2 to 4 carbon atoms is added at a ratio of 1 to 30 moles in total to 1 mole of a monohydric aliphatic alcohol having a hydroxy group at a β-position of an alkyl chain with 4 or more carbon atoms.

By containing the polyoxyalkylene alkyl ether, the bundling property of synthetic fibers can be improved suitably. The monohydric aliphatic alcohol may be a saturated aliphatic alcohol or an unsaturated aliphatic alcohol. Alternatively, the monohydric aliphatic alcohol may be a straight chain aliphatic alcohol or an aliphatic alcohol having a branched chain.

Specific examples of the polyoxyalkylene alkyl ether include a compound in which 3 moles of ethylene oxide are added to 1 mole of 2-dodecanol, a compound in which 5 moles of ethylene oxide are added to 1 mole of 2-dodecanol, a compound in which 7 moles of ethylene oxide are added to 1 mole of 2-dodecanol, a compound in which 9 moles of ethylene oxide are added to 1 mole of 2-dodecanol, a compound in which 12 moles of ethylene oxide are added to 1 mole of 2-dodecanol, a compound in which 30 moles of ethylene oxide are added to 1 mole of 2-dodecanol, a compound in which 3 moles of ethylene oxide are added to 1 mole of 2-tridecanol, a compound in which 5 moles of ethylene oxide are added to 1 mole of 2-tridecanol, a compound in which 7 moles of ethylene oxide are added to 1 mole of 2-tridecanol, a compound in which 9 moles of ethylene oxide are added to 1 mole of 2-tridecanol, a compound in which 12 moles of ethylene oxide are added to 1 mole of 2-tridecanol, a compound in which 3 moles of ethylene oxide are added to 1 mole of 2-tetradecanol, a compound in which 5 moles of ethylene oxide are added to 1 mole of 2-tetradecanol, a compound in which 7 moles of ethylene oxide are added to 1 mole of 2-tetradecanol, a compound in which 9 moles of ethylene oxide are added to 1 mole of 2-tetradecanol, a compound in which 12 moles of ethylene oxide are added to 1 mole of 2-tetradecanol, a compound in which 15 moles of ethylene oxide are added to 1 mole of 2-tetradecanol, a compound in which 9 moles of ethylene oxide are added to 1 mole of 2-decanol, a compound in which 9 moles of ethylene oxide are added to 1 mole of 2-octadecanol, a compound in which 5 moles of ethylene oxide are added to 1 mole of 2-nonanol, and a compound in which 7 moles of ethylene oxide and 3 moles of propylene oxide are added to 1 mole of 2-dodecanol.

One type of the above polyoxyalkylene alkyl ether may be used alone or two or more types thereof may be used in combination.

The monohydric aliphatic alcohol is preferably that having the hydroxy group at a β-position of an alkyl chain with 10 to 18 carbon atoms and more preferably that having the hydroxy group at a β-position of an alkyl chain with 12 to 16 carbon atoms. By using the monohydric aliphatic alcohol having the hydroxy group at a β-position of an alkyl chain with 10 to 18 carbon atoms, the bundling property can be improved further. By using the monohydric aliphatic alcohol having the hydroxy group at a β-position of an alkyl chain with 12 to 16 carbon atoms, the wound shape of a synthetic fiber can be maintained more neatly as will be described below.

Specific examples of the alkylene oxide include, ethylene oxide, propylene oxide, and butylene oxide. Among these, ethylene oxide is preferable. The polymerization sequence is not restricted in particular and may be either a block adduct or a random adduct.

One type of the alkylene oxide may be used alone or two or more types thereof may be used in combination.

The treatment agent of the present embodiment preferably contains a silicone.

Examples of the silicone include a dimethyl silicone, phenyl-modified silicone, amino-modified silicone, amide-modified silicone, polyether-modified silicone, aminopolyether-modified silicone, alkyl-modified silicone, alkyl aralkyl-modified silicone, alkyl polyether-modified silicone, ester-modified silicone, epoxy-modified silicone, carbinol-modified silicone, and mercapto-modified silicone. Among the above, it is more preferable for an amino-modified silicone to be contained.

Specific examples of the silicone include a diamine type amino-modified silicone with a viscosity of 250 $mm^2/s$ and an equivalent weight of 7,600 g/mol, a diamine type amino-modified silicone with a viscosity of 1,300 $mm^2/s$ and an equivalent weight of 1,700 g/mol, a monoamine type amino-modified silicone with a viscosity of 1,700 $mm^2/s$ and an equivalent weight of 3,800 g/mol, a diamine type amino-modified silicone with a viscosity of 5,000 $mm^2/s$ and an equivalent weight of 7,000 g/mol, a diamine type amino-modified silicone with a viscosity of 1,0000 $mm^2/s$ and an equivalent weight of 2,000 g/mol, a diamine type amino-modified silicone with a viscosity of 600 $mm^2/s$ and an equivalent weight of 3,000 g/mol, a diamine type amino-modified silicone with a viscosity of 80 $mm^2/s$ and an equivalent weight of 4,000 g/mol, a dimethyl silicone with a viscosity of 1,0000 $mm^2/s$, a polyether-modified silicone with a viscosity of 500 $mm^2/s$ and with ethylene oxide/propylene oxide=100/0 and mass ratio of silicone/polyether=50/50, and a polyether-modified silicone with a viscosity of 1,700 $mm^2/s$ and with ethylene oxide/propylene oxide=40/60 and mass ratio of silicone/polyether=20/80.

One type of the silicone may be used alone or two or more types thereof may be used in combination.

The contents of the polyoxyalkylene alkyl ether and the silicone are not restricted. If the sum of the contents of the polyoxyalkylene alkyl ether and the silicone is taken as 100 parts by mass, it is more preferable for the treatment agent to contain the polyoxyalkylene alkyl ether at a ratio of 5 to 80 parts by mass and the silicone at a ratio of 95 to 20 parts by mass. By specifying to be of such ratios, the smoothness of a synthetic fiber can be improved as will be described below.

Second Embodiment

A second embodiment that embodies a synthetic fiber according to the present invention will now be described. The synthetic fiber of the present embodiment has the treatment agent of the first embodiment adhered thereto. The synthetic fiber is not restricted in particular, and specific examples thereof include (1) polyethylene terephthalate, polypropylene terephthalate, polylactic acid ester, and other polyester fibers, (2) nylon 6, nylon 66, and other polyamide fibers, (3) polyacrylic, modacrylic, and other polyacrylic fibers, (4) polyethylene, polypropylene, and other polyolefin fibers, (5) cellulose fibers, and (6) lignin fibers. As the synthetic fibers, a carbon fiber precursor is preferable that is made of resin and becomes carbon fibers by undergoing a carbonization step to be described below. The resin constituting the carbon fiber precursor is not restricted in particular, and specific examples thereof include an acrylic resin, polyethylene resin, phenol resin, cellulose resin, lignin resin, and pitch.

The amount of the treatment agent of the first embodiment to be adhered to the synthetic fiber is not restricted in particular, and the treatment agent (not including solvent) is adhered such as to be preferably 0.1% to 2% by mass and more preferably 0.3% to 1.2% by mass with respect to the synthetic fiber.

Examples of the form of the treatment agent of the first embodiment when adhering the treatment agent to the fiber include an organic solvent solution and an aqueous liquid.

The method for adhering the treatment agent to the synthetic fiber may be a method of using, for example, an aqueous liquid containing the treatment agent of the first embodiment and water or using a further diluted aqueous solution to adhere by a known method such as an immersion method, a spray method, a roller method, or a guide oiling method using a metering pump.

A method for producing a carbon fiber using the synthetic fiber of the present embodiment will now be described.

The method for producing a carbon fiber preferably includes the following Steps 1 to 3.

Step 1: a yarn making step of making a yarn by adhering the treatment agent of the first embodiment to the synthetic fiber.

Step 2: a flame-resisting treatment step of converting the synthetic fiber obtained in Step 1 to a flame-resistant fiber in an oxidizing atmosphere of 200° C. to 300° C. and preferably 230° C. to 270° C.

Step 3: a carbonization step of carbonizing the flame-resistant fiber obtained in Step 2 in an inert atmosphere of 300° C. to 2,000° C. and preferably 300° C. to 1,300° C.

The yarn making step preferably further include a wet spinning step of dissolving a resin in a solvent and spinning it into a fiber, a dry densification step of drying and densifying the wet-spun synthetic fiber, and a drawing step of drawing the dry densified synthetic fiber.

Although a temperature of the dry densification step is not restricted in particular, the synthetic fiber that has undergone the wet spinning step is preferably heated, for example, at 70° C. to 200° C. Although a timing at which the treatment agent is adhered to the synthetic fiber is not restricted in particular, it is preferably between the wet spinning step and the dry densification step.

The oxidizing atmosphere in the flame-resisting treatment step is not restricted in particular and may be, for example, an air atmosphere.

The inert atmosphere in the carbonization step is not restricted in particular and may be, for example, a nitrogen atmosphere, an argon atmosphere, or a vacuum atmosphere.

The following effects can be obtained by the treatment agent and the synthetic fiber of the embodiments.

(1) The treatment agent of the embodiments contains the specific polyoxyalkylene alkyl ether. This allows improvement of the bundling property of synthetic fibers. In addition, the smoothness of the synthetic fibers can be improved. Further, when the synthetic fibers are wound, the wound shape can be maintained neatly. In particular, shapes of end surfaces when wound around a bobbin can be maintained neatly and improvement of winding efficiency and unwinding efficiency can be achieved.

(2) The treatment agent is adhered to a synthetic fiber between the wet spinning step and the dry densification step. The bundling property of synthetic fibers that have undergone the dry densification step and the drawing step can be improved.

The above-described embodiments can be modified as follows. The above-described embodiments and the following modifications can be implemented upon being combined with each other within a range that is not technically inconsistent.

Although in the embodiments, the treatment agent is adhered to a synthetic fiber between the wet spinning step and the dry densification step, there is no restriction to this mode. The treatment agent may be adhered to a synthetic fiber between the dry densification step and the drawing step or the treatment agent may be adhered to a synthetic fiber between the drawing step and the flame-resisting treatment step.

Although in the embodiments, the synthetic fiber treatment agent contains a silicone, there is no restriction to this mode. The silicone may be omitted.

In the embodiments, for example, the synthetic fiber may be a fiber on which the flame-resisting treatment step is performed but on which the carbonization step is not performed.

Stabilizers, antistatic agents, electrostatic preventing agents, binders, antioxidant agents, ultraviolet absorbers, and other ingredients that are ordinarily used in treatment agents or aqueous liquids (also referred to hereinafter as other ingredients) for quality maintenance of the treatment agents or the aqueous liquids may further be blended in the treatment agent or the aqueous liquid of the embodiments within a range that does not impair the effects of the present invention.

EXAMPLES

Examples will now be given below to describe the features and effects of the present invention more specifically, but the present invention is not restricted to these examples. In the following description of examples and comparative examples, parts means parts by mass and % means % by mass.

Experimental Part 1 (Preparation of Synthetic Fiber Treatment Agents)

Example 1

The respective ingredients shown in Table 1 were used and added to a beaker such that blending ratios are 30 parts of a polyoxyalkylene alkyl ether (A-4) and 70 parts of a silicone (B-1). These were mixed well by stirring. While continuing to stir, ion exchanged water was added gradually to achieve a solids concentration of 25% and thereby prepare a 25% aqueous liquid of a synthetic fiber treatment agent of Example 1.

Examples 2 to 18 and Comparative Examples 1 to 4

Respective synthetic fiber treatment agents of Examples 2 to 18 and Comparative Examples 1 to 4 were prepared using the respective ingredients shown in Table 1 and in accordance with the same procedure as Example 1.

The type and content of the polyoxyalkylene alkyl ether, the type and content of the silicone, and the type and content of the other ingredient in each example are as respectively indicated in the "(A) Polyoxyalkylene alkyl ether" column, the "(B) Silicone" column, and the "(C) Other ingredient" column of Table 1.

TABLE 1

| | (A) Polyoxyalkylene alkyl ether | | (B) Silicone | | (C) Other component | | Evaluation | | |
|---|---|---|---|---|---|---|---|---|---|
| | Symbol | Parts by mass | Symbol | Parts by mass | Symbol | Parts by mass | Bundling property | Wound shape | Smoothness |
| Example 1 | A-4 | 30 | B-1 | 70 | — | — | ○○ | ○○ | ○○○ |
| Example 2 | A-10 | 64 | B-2 | 35 | C-1 | 1 | ○○ | ○○ | ○○○ |
| Example 3 | A-1 | 3 | B-3 | 80 | C-3 | 2 | ○○ | ○○ | ○○○ |
| | A-2 | 3 | | | | | | | |
| | A-6 | 7.5 | | | | | | | |
| | A-9 | 4.5 | | | | | | | |
| Example 4 | A-3 | 6 | B-4 | 69.5 | C-4 | 0.5 | ○○ | ○○ | ○○○ |
| | A-6 | 15 | | | | | | | |
| | A-9 | 9 | | | | | | | |
| Example 5 | A-3 | 8 | B-5 | 60 | C-6 | 2 | ○○ | ○○ | ○○○ |
| | A-5 | 20 | B-10 | 5 | | | | | |
| | A-11 | 5 | | | | | | | |

TABLE 1-continued

| | (A) Polyoxyalkylene alkyl ether | | (B) Silicone | | (C) Other component | | Evaluation | | |
|---|---|---|---|---|---|---|---|---|---|
| | Symbol | Parts by mass | Symbol | Parts by mass | Symbol | Parts by mass | Bundling property | Wound shape | Smoothness |
| Example 6 | A-4 | 12 | B-6 | 40 | C-5 | 0.5 | ○○ | ○○ | ○○○ |
| | A-7 | 25 | | | | | | | |
| | A-10 | 17.5 | | | | | | | |
| | a-4 | 5 | | | | | | | |
| Example 7 | A-4 | 2 | B-7 | 85 | C-2 | 1 | ○○ | ○○ | ○○○ |
| | A-7 | 3 | | | | | | | |
| | A-10 | 4 | | | | | | | |
| | a-2 | 5 | | | | | | | |
| Example 8 | A-2 | 9.2 | B-2 | 10 | C-4 | 0.8 | ○○ | ○○ | ○○○ |
| | A-6 | 25 | B-3 | 10 | C-7 | 30 | | | |
| | A-9 | 15 | | | | | | | |
| Example 9 | A-1 | 6 | B-1 | 20 | C-4 | 1 | ○○ | ○○ | ○○○ |
| | A-12 | 10 | B-3 | 50 | | | | | |
| | A-13 | 8 | | | | | | | |
| | A-5 | 5 | | | | | | | |
| Example 10 | A-3 | 10 | B-2 | 16 | C-4 | 1 | ○○ | ○○ | ○○○ |
| | A-14 | 28 | B-3 | 10 | C-7 | 20 | | | |
| | A-15 | 15 | | | | | | | |
| Example 11 | A-1 | 10 | B-7 | 68 | C-2 | 2 | ○○ | ○○ | ○○○ |
| | A-8 | 4 | | | | | | | |
| | A-16 | 10 | | | | | | | |
| | A-17 | 6 | | | | | | | |
| Example 12 | A-18 | 10 | B-8 | 68.5 | C-4 | 1 | ○○ | ○○ | ○○ |
| | A-6 | 10 | | | C-5 | 0.5 | | | |
| | A-22 | 10 | | | | | | | |
| Example 13 | A-4 | 30 | B-9 | 20 | C-3 | 5 | ○○ | ○○ | ○○ |
| | A-7 | 30 | | | | | | | |
| | a-7 | 15 | | | | | | | |
| Example 14 | A-2 | 10 | B-10 | 35 | C-1 | 5 | ○○ | ○○ | ○○ |
| | a-1 | 30 | | | | | | | |
| | a-5 | 20 | | | | | | | |
| Example 15 | A-3 | 10 | — | — | C-7 | 50 | ○○ | ○○ | ○ |
| | a-3 | 40 | | | | | | | |
| Example 16 | A-19 | 40 | — | — | C-7 | 60 | ○○ | ○ | ○ |
| Example 17 | A-20 | 19 | — | — | C-4 | 1 | ○○ | ○ | ○ |
| | | | | | C-7 | 80 | | | |
| Example 18 | A-21 | 85 | — | — | C-3 | 5 | ○ | ○ | ○ |
| | | | | | C-7 | 10 | | | |
| Comparative Example 1 | a-1 | 100 | — | — | — | — | x | x | x |
| Comparative Example 2 | a-2 | 94 | — | — | C-1 | 6 | x | x | x |
| Comparative Example 3 | a-6 | 30 | B-1 | 20 | C-4 | 0.5 | x | x | ○ |
| | a-7 | 49.5 | | | | | | | |
| Comparative Example 4 | a-1 | 40 | — | — | — | — | x | x | x |
| | a-7 | 60 | | | | | | | |

Details of the respective ingredients A-1 to A-22, a-1 to a-7, B-1 to B-10, and C-1 to C-7 indicated in the symbol columns of Table 1 are as follows.

(Polyoxyalkylene Alkyl Ethers)

A-1: compound in which 3 moles of ethylene oxide are added to 1 mole of 2-dodecanol A-2: compound in which 5 moles of ethylene oxide are added to 1 mole of 2-dodecanol A-3: compound in which 7 moles of ethylene oxide are added to 1 mole of 2-dodecanol A-4: compound in which 9 moles of ethylene oxide are added to 1 mole of 2-dodecanol A-5: compound in which 30 moles of ethylene oxide are added to 1 mole of 2-dodecanol A-6: compound in which 5 moles of ethylene oxide are added to 1 mole of 2-tridecanol A-7: compound in which 9 moles of ethylene oxide are added to 1 mole of 2-tridecanol A-8: compound in which 12 moles of ethylene oxide are added to 1 mole of 2-tridecanol A-9: compound in which 5 moles of ethylene oxide are added to 1 mole of 2-tetradecanol A-10: compound in which 9 moles of ethylene oxide are added to 1 mole of 2-tetradecanol A-11: compound in which 15 moles of ethylene oxide are added to 1 mole of 2-tetradecanol A-12: compound in which 3 moles of ethylene oxide are added to 1 mole of 2-tridecanol A-13: compound in which 3 moles of ethylene oxide are added to 1 mole of 2-tetradecanol A-14: compound in which 7 moles of ethylene oxide are added to 1 mole of 2-tridecanol A-15: compound in which 7 moles of ethylene oxide are added to 1 mole of 2-tetradecanol A-16: compound in which 12 moles of ethylene oxide are added to 1 mole of 2-dodecanol A-17: compound in which 12 moles of ethylene oxide are added to 1 mole of 2-tetradecanol A-18: compound in which 7 moles of ethylene oxide are added to 1 mole of 2-hexadecanol A-19: compound in which 9 moles of ethylene oxide are added to 1 mole of 2-decanol A-20: compound in which 9 moles of ethylene oxide are added to 1 mole of 2-octadecanol A-21: compound in which 5 moles of ethylene oxide are added to 1 mole of 2-nonanol A-22: compound in which 7 moles of ethylene oxide and 3 moles of propylene oxide are added to 1 mole of 2-dodecanol a-1: compound in which 7 moles of ethylene oxide are added to 1 mole of 4-dodecanol a-2: compound in which 9 moles of ethylene oxide are added to 1 mole of 6-dodecanol a-3: compound in which 9 moles of ethylene oxide are added to 1 mole of 6-tridecanol a-4: compound in which 9 moles of ethylene oxide are added to 1 mole of 3-tetradecanol a-5: compound in which 9 moles of ethylene oxide are added to 1 mole of 7-tetradecanol a-6: compound in which 5 moles of ethylene oxide are added to 1 mole of 1-dodecanol a-7: compound in which 5 moles of ethylene oxide are added to 1 mole of 1-tetradecanol The type of polyoxyalkylene alkyl ether and the number of carbon atoms and the position of the hydroxy group of the monohydric aliphatic alcohol used in each of the polyoxyalkylene alkyl ethers above are respectively indicated in the "(A) Polyoxyalkylene alkyl ether" column, the "Number of carbon atoms of monohydric aliphatic alcohol" column, and the "Position of hydroxy group" column of Table 2.

TABLE 2

| Symbol | (A) Polyoxyalkylene alkyl ether | Number of carbon atoms of monohydric aliphatic alcohol | Position of hydroxy group |
|---|---|---|---|
| A-1 | Compound in which 3 moles of ethylene oxide are added to 1 mole of 2-dodecanol | 12 | β-position |
| A-2 | Compound in which 5 moles of ethylene oxide are added to 1 mole of 2-dodecanol | 12 | β-position |
| A-3 | Compound in which 7 moles of ethylene oxide are added to 1 mole of 2-dodecanol | 12 | β-position |
| A-4 | Compound in which 9 moles of ethylene oxide are added to 1 mole of 2-dodecanol | 12 | β-position |
| A-5 | Compound in which 30 moles of ethylene oxide are added to 1 mole of 2-dodecanol | 12 | β-position |
| A-6 | Compound in which 5 moles of ethylene oxide are added to 1 mole of 2-tridecanol | 13 | β-position |
| A-7 | Compound in which 9 moles of ethylene oxide are added to 1 mole of 2-tridecanol | 13 | β-position |
| A-8 | Compound in which 12 moles of ethylene oxide are added to 1 mole of 2-tridecanol | 13 | β-position |
| A-9 | Compound in which 5 moles of ethylene oxide are added to 1 mole of 2-tetradecanol | 14 | β-position |
| A-10 | Compound in which 9 moles of ethylene oxide are added to 1 mole of 2-tetradecanol | 14 | β-position |
| A-11 | Compound in which 15 moles of ethylene oxide are added to 1 mole of 2-tetradecanol | 14 | β-position |
| A-12 | Compound in which 3 moles of ethylene oxide are added to 1 mole of 2-tridecanol | 13 | β-position |
| A-13 | Compound in which 3 moles of ethylene oxide are added to 1 mole of 2-tetradecanol | 14 | β-position |
| A-14 | Compound in which 7 moles of ethylene oxide are added to 1 mole of 2-tridecanol | 13 | β-position |
| A-15 | Compound in which 7 moles of ethylene oxide are added to 1 mol e of 2-tetradecanol | 14 | β-position |
| A-16 | Compound in which 12 moles of ethylene oxide are added to 1 mole of 2-dodecanol | 12 | β-position |
| A-17 | Compound in which 12 moles of ethylene oxide are added to 1 mole of 2-tetradecanol | 14 | β-position |
| A-18 | Compound in which 7 moles of ethylene oxide are added to 1 mole of 2-hexadecanol | 16 | β-position |
| A-19 | Compound in which 9 moles of ethylene oxide are added to 1 mole of 2-decanol | 10 | β-position |
| A-20 | Compound in which 9 moles of ethylene oxide are added to 1 mole of 2-octadecanol | 18 | β-position |
| A-21 | Compound in which 5 moles of ethylene oxide are added to 1 mole of 2-nonanol | 9 | β-position |
| A-22 | Compound in which 7 moles of ethylene oxide and 3 moles of propylene oxide are added to 1 mole of 2-dodecanol | 12 | β-position |
| a-1 | Compound in which 7 moles of ethylene oxide are added to 1 mole of 4-dodecanol | 12 | δ-position |
| a-2 | Compound in which 9 moles of ethylene oxide are added to 1 mole of 6-dodecanol | 12 | ζ-position |
| a-3 | Compound in which 9 moles of ethylene oxide are added to 1 mole of 6-tridecanol | 13 | ζ-position |
| a-4 | Compound in which 9 moles of ethylene oxide are added to 1 mole of 3-tetradecanol | 14 | γ-position |
| a-5 | Compound in which 9 moles of ethylene oxide are added to 1 mole of 7-tetradecanol | 14 | η-position |

TABLE 2-continued

| Symbol | (A) Polyoxyalkylene alkyl ether | Number of carbon atoms of monohydric aliphatic alcohol | Position of hydroxy group |
|---|---|---|---|
| a-6 | Compound in which 5 moles of ethylene oxide are added to 1 mole of 1-dodecanol | 12 | α-position |
| a-7 | Compound in which 5 moles of ethylene oxide are added to 1 mole of 1-tetradecanol | 14 | α-position |

(Silicones)

B-1: diamine type amino-modified silicone with a viscosity of 250 $mm^2/s$ and an equivalent weight of 7,600 g/mol B-2: diamine type amino-modified silicone with a viscosity of 1,300 $mm^2/s$ and an equivalent weight of 1,700 g/mol B-3: monoamine type amino-modified silicone with a viscosity of 1,700 $mm^2/s$ and an equivalent weight of 3,800 g/mol B-4: diamine type amino-modified silicone with a viscosity of 5,000 $mm^2/s$ and an equivalent weight of 7,000 g/mol B-5: diamine type amino-modified silicone with a viscosity of 10,000 $mm^2/s$ and an equivalent weight of 2,000 g/mol B-6: diamine type amino-modified silicone with a viscosity of 600 $mm^2/s$ and an equivalent weight of 3,000 g/mol B-7: diamine type amino-modified silicone with a viscosity of 80 $mm^2/s$ and an equivalent weight of 4,000 g/mol B-8: dimethyl silicone with a viscosity of 10,000 $mm^2/s$ B-9: polyether-modified silicone with a viscosity of 500 $mm^2/s$ and with ethylene oxide/propylene oxide=100/0 and mass ratio of silicone/polyether=50/50

B-10: polyether-modified silicone with a viscosity of 1,700 $mm^2/s$ and with ethylene oxide/propylene oxide=40/60 and mass ratio of silicone/polyether=20/80

(Other Ingredients)

C-1: ethyl sulfuric acid salt of 1-ethyl-2-(heptadecenyl)-4,5-dihydro-3-(2-hydroxyethyl)-1H-imidazolinium C-2: isododecyl phosphate C-3: polyoxyethylene (n=10) lauryl ether acetic acid C-4: acetic acid C-5: diethanolamine C-6: lauroyl sarcosinate C-7: didodecyl ester of 2 mole ethylene oxide adduct of bisphenol A

Experimental Part 2 (Production of Synthetic Fibers and Carbon Fibers)

Synthetic fibers and carbon fibers were produced using the synthetic fiber treatment agents prepared in Experimental Part 1.

First, as Step 1, an acrylic resin was wet spun as synthetic fibers. Specifically, a copolymer of 1.80 limiting viscosity constituted of 95% by mass acrylonitrile, 3.5% by mass methyl acrylate, and 1.5% by mass methacrylic acid was dissolved in dimethylacetamide (DMAC) to prepare a spinning dope with a polymer concentration of 21.0% by mass and a viscosity at 60° C. of 500 poise. The spinning dope was discharged at a draft ratio of 0.8 from a spinneret with 12,000 holes of 0.075 mm hole diameter (inner diameter) into a coagulation bath of a 70% by mass aqueous solution of DMAC maintained at a spinning bath temperature of 35° C.

The coagulated yarn was drawn by 5 times at the same time as being desolvated in a rinse tank to prepare acrylic fiber strands (raw material fibers) in a water-swollen state. To these acrylic fiber strands, the synthetic fiber treatment agents prepared in Experimental Part 1 were each applied such that a solids adhesion amount would be 1% by mass (not including the solvent). Application of each synthetic fiber treatment agent was performed by an immersion method using a 4% ion exchanged water solution of the synthetic fiber treatment agent. Thereafter, the acrylic fiber strands were subject to dry densification by a heating roller set at 130° C., further subject to drawing by 1.7 times between heating rollers set at 170° C., and thereafter wound around a spool (also referred to hereinafter as bobbin) using a winding device (also referred to hereinafter as winder).

Next, as Step 2, yarns were unwound from the wound synthetic fibers and, after being subject to flame-resisting treatment for 1 hour under an air atmosphere in a flame-resisting treatment furnace having a temperature gradient of 230° C. to 270° C., were wound around a bobbin to obtain flame-resistant yarns (flame-resistant fibers).

Next, as Step 3, yarns were unwound from the wound flame-resistant yarns and, after conversion to carbon fibers by baking under a nitrogen atmosphere in a carbonizing furnace having a temperature gradient of 300° C. to 1,300° C., were wound around a bobbin to obtain the carbon fibers.

Experimental Part 3 (Evaluation)

Regarding each of the treatment agents of Examples 1 to 18 and Comparative Examples 1 to 4, the bundling property of synthetic fibers, the wound shape of synthetic fibers, and the smoothness of synthetic fibers were evaluated. Procedures of the respective tests are described below. The test results are shown in the "Bundling property," "Wound shape," and "Smoothness" columns of Table 1.

(Bundling Property)

The acrylic fiber strands to which the synthetic fiber treatment agent has been applied were visually observed in regard to the bundling state when passing through the heating rollers in Step 1 of Experimental Part 2 and the bundling property was evaluated based on the following criteria.

Evaluation Criteria of Bundling Property of Synthetic Fibers

○○ (satisfactory): The bundling property is good, there is no winding around the heating rollers, and there are no problems at all in operability.

○ (fair): Although yarns become unraveled slightly, there is no yarn cutting and there are no problems in operability.

x (poor): There is much unraveling of yarns, yarn cutting occurs frequently, and operability is affected.

(Wound Shape)

The shape of the synthetic fibers when wound by the winder in Step 1 of Experimental Part 2 was observed visually and the wound shape was evaluated based on the following criteria. Ordinarily when synthetic fibers are wound by the winder, the synthetic fibers are wound in a cylindrical shape along a circumferential surface of the bobbin.

Evaluation Criteria of Wound Shape

○○ (satisfactory): A neat cylindrical shape is maintained even when not less than 100 kg of the synthetic fibers are wound.

○ (fair): A neat cylindrical shape is maintained in a state at which not less than 80 kg but less than 100 kg of the synthetic fibers are wound.

x (poor): A neat cylindrical shape cannot be maintained in a state at which less than 80 kg of the synthetic fibers are wound.

Here, that a neat cylindrical shape cannot be maintained shall mean a state where a circumferential surface of the cylindrical shape has become uneven due to variation in the winding state of the synthetic fibers and/or a state where a prolate spheroidal shape is formed due to deviation of the position of the wound synthetic fibers.

(Smoothness)

As a device for measuring smoothness, Autograph ABS-1kNX (tensile tester) manufactured by Shimadzu Corporation was used.

As shown in FIG. 1, the synthetic fiber with the treatment agent adhered (also referred to hereinafter as test yarn 1) was fixed at one end to a gripping tool 2 of the autograph and successively passed along a free roller 3, a chrome-plated textured pin 4, and a free roller 5 and a weight 6 of 50 g was fixed to the other end of the test yarn 1. A drive shaft 4*a* that the test yarn 1 contacts at the chrome-plated textured pin 4 is 1 cm in diameter and 2S in surface roughness. An angle formed by a direction in which the test yarn 1 extends between the chrome-plated textured pin 4 and the free roller 5 with respect to a direction in which the test yarn 1 extends between the free roller 3 and the chrome-plated textured pin 4 was set to 90°. In this state and under conditions of 25° C. and 60% RH, the drive shaft 4*a* of the chrome-plated textured pin 4 was put in a state of being rotated at a speed of 100 m/minute circumferential speed in a direction in which tension is applied to the autograph and the tension was measured by the autograph every 0.1 seconds for 30 seconds. An average value (N) of the tension during this time was determined and evaluated based on the following criteria.

○○○ (excellent): The average value of tension is less than 2N.

○○ (satisfactory): The average value of tension is not less than 2N but less than 3N.

○ (fair): The average value of tension is not less than 3N but less than 4N.

x (poor): The average value of tension is not less than 4N.

Based on the results of Table 1, the present invention succeeds in suitably improving the bundling property of synthetic fibers. In addition, the wound shape can be maintained neatly when the synthetic fibers are wound. The smoothness of the synthetic fibers can also be improved.

The invention claimed is:

1. A synthetic fiber treatment agent comprising:

a polyoxyalkylene alkyl ether in which an alkylene oxide with 2 to 4 carbon atoms is added at a ratio of 12 to 30 moles in total to 1 mole of a monohydric aliphatic alcohol having a hydroxy group at a β-position of an alkyl chain with 4 or more carbon atoms; and a silicone selected from the group consisting of dimethyl silicone and polyether-modified silicone.

2. The synthetic fiber treatment agent according to claim 1, wherein the alkylene oxide contains ethylene oxide.

3. The synthetic fiber treatment agent according to claim 1, wherein the monohydric aliphatic alcohol has the hydroxy group at a β-position of an alkyl chain with 10 to 18 carbon atoms.

4. The synthetic fiber treatment agent according to claim 1, wherein the monohydric aliphatic alcohol has the hydroxy group at a β-position of an alkyl chain with 12 to 16 carbon atoms.

5. The synthetic fiber treatment agent according to claim 1, wherein a content of the polyoxyalkylene alkyl ether is 5 to 80 parts by mass and a content of the silicone is 95 to 20 parts by mass, wherein the sum of the contents of the polyoxyalkylene alkyl ether and the silicone is taken as 100 parts by mass.

6. The synthetic fiber treatment agent according to claim 1, wherein the synthetic fiber is a carbon fiber precursor.

7. A synthetic fiber to which the synthetic fiber treatment agent according to claim 1 is adhered.

* * * * *